US009971376B2

(12) United States Patent
Lee

(10) Patent No.: US 9,971,376 B2
(45) Date of Patent: May 15, 2018

(54) VOLTAGE REFERENCE CIRCUITS WITH PROGRAMMABLE TEMPERATURE SLOPE AND INDEPENDENT OFFSET CONTROL

(71) Applicant: Kilopass Technology, Inc., San Jose, CA (US)

(72) Inventor: Sang-soo Lee, Cupertino, CA (US)

(73) Assignee: Kilopass Technology, Inc., San Jose, CA (US)

( * ) Notice: Subject to any disclaimer, the term of this patent is extended or adjusted under 35 U.S.C. 154(b) by 0 days. days.

(21) Appl. No.: 15/288,824

(22) Filed: Oct. 7, 2016

(65) Prior Publication Data

US 2018/0101190 A1 Apr. 12, 2018

(51) Int. Cl.
*G05F 3/26* (2006.01)

(52) U.S. Cl.
CPC ..... *G05F 3/262* (2013.01)

(58) Field of Classification Search
CPC ..... G05F 3/225; G05F 3/245
See application file for complete search history.

(56) References Cited

U.S. PATENT DOCUMENTS 7,443,227 B2 * 10/2008 Lin ..... G05F 3/30 327/525
8,022,751 B2 * 9/2011 Le ..... G05F 3/30 323/313
8,931,953 B2 * 1/2015 Law ..... G01K 7/01 340/10.1

OTHER PUBLICATIONS

ISL21400 Programmable Temperature Slope Voltage Reference, Intersil, Application Note, Jan. 16, 2009 (18 pages).

* cited by examiner

*Primary Examiner* — Jeffrey Zweizig
(74) *Attorney, Agent, or Firm* — Fenwick & West LLP

(57) ABSTRACT

Voltage reference circuits configured to generate a voltage reference with a programmable temperature slope are disclosed. By combining and programming a PTAT (Proportional To Absolute Temperature) voltage generation circuit and a CTAT (Complementary To Absolute Temperature) voltage generation circuit, desired temperature slope for the voltage reference is obtained. To adjust both temperature slope and offset of the voltage reference, the voltage reference circuits include a bandgap reference circuit. The bandgap reference circuit is used to create a temperature independent current, which is coupled to a programmable string of resistors and programmable string of MOSFETs to produce a desired temperature slope for the voltage reference. The desired offset of the voltage reference is obtained by the temperature-independent current into another string of programmable resistors. A circuit architecture and method to control the temperature slope and offset of the voltage reference independently is disclosed.

18 Claims, 12 Drawing Sheets

900

$V_{DD}$
960
920
WRITE SLOPE
W0[3:0]
930
READ SLOPE
R0[3:0]
940
STANDBY SLOPE
S0[3:0]
WRITE OFFSET
W1[4:0]
922
READ OFFSET
R1[4:0]
932
STANDBY OFFSET
S1[4:0]
942
PROGRAMMABLE VOLTAGE REFERENCE
$V_{SS}$
962
$V_{bg}$
950
BANDGAP REFERENCE
$V_{Wout}$
924
WRITE-MODE VOLTAGE REFERENCE
$V_{Rout}$
READ-MODE VOLTAGE REFERENCE
934
$V_{Sout}$
STANDBY-MODE VOLTAGE REFERENCE
944

1000

0.6
0.4
0.2
0
-0.2
-0.4
-0.6
-0.8
-1
-1.2
-1.4
1008
1006
1004
1002
-40 °C
0 °C
25 °C
70 °C
100 °C

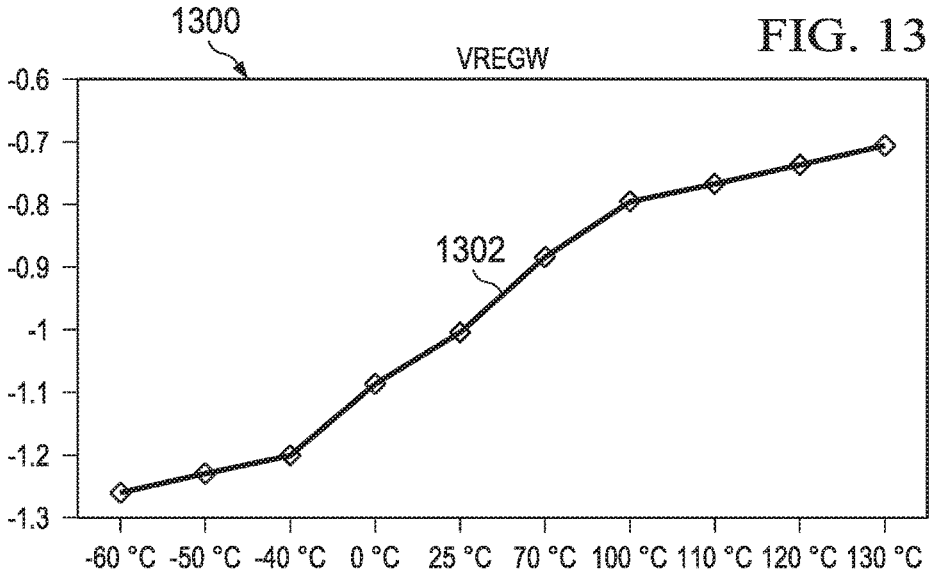
FIG. 13
FIG. 14
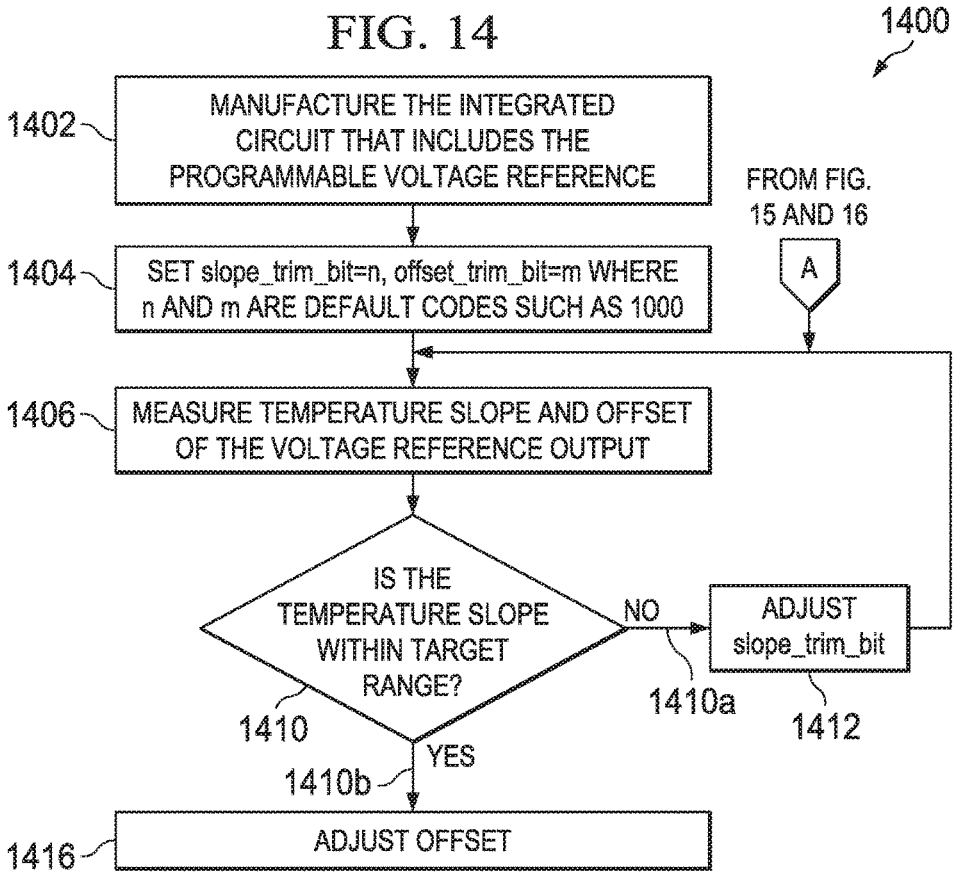

VOLTAGE REFERENCE CIRCUITS WITH PROGRAMMABLE TEMPERATURE SLOPE AND INDEPENDENT OFFSET CONTROL

FIELD OF THE DISCLOSURE

The present disclosure relates generally to semiconductor integrated circuits, and more particularly to analog voltage reference circuits with programmable temperature slope.

BACKGROUND OF THE DISCLOSURE

Very-large-scale-integration (VLSI) circuits require stable and predictable voltage references over PVT (Process, supply Voltage, and Temperature) variations. Often, bandgap voltage reference circuits are used to produce these temperature independent voltage references. However, conventional bandgap voltage reference circuits do not allow for separately programmable temperature slope and programmable voltage offset control.

BRIEF DESCRIPTION OF THE DRAWINGS

Further features of the disclosure, its nature and various advantages will be apparent upon consideration of the following detailed description, taken in conjunction with the accompanying drawings, in which like reference characters refer to like parts throughout, and in which:

FIG. 13 shows simulation results of a programmable voltage reference circuit with extended temperature range from −60° C. to 130° C., according to an illustrative implementation;

FIG. 14 depicts a flowchart of a process for generating the desired temperature slope and offset of the voltage reference output, according to an illustrative implementation;

DETAILED DESCRIPTION OF THE DRAWINGS

A voltage reference circuit configured to generate a voltage with a programmable temperature slope is disclosed. The voltage reference circuit includes a bandgap reference circuit configured to generate a Proportional To Absolute Temperature (PTAT) current, Complementary To Absolute Temperature (CTAT) current, and a bandgap voltage reference. The bandgap voltage reference is used to create a temperature independent offset voltage in the final voltage reference output.

Figure 1:
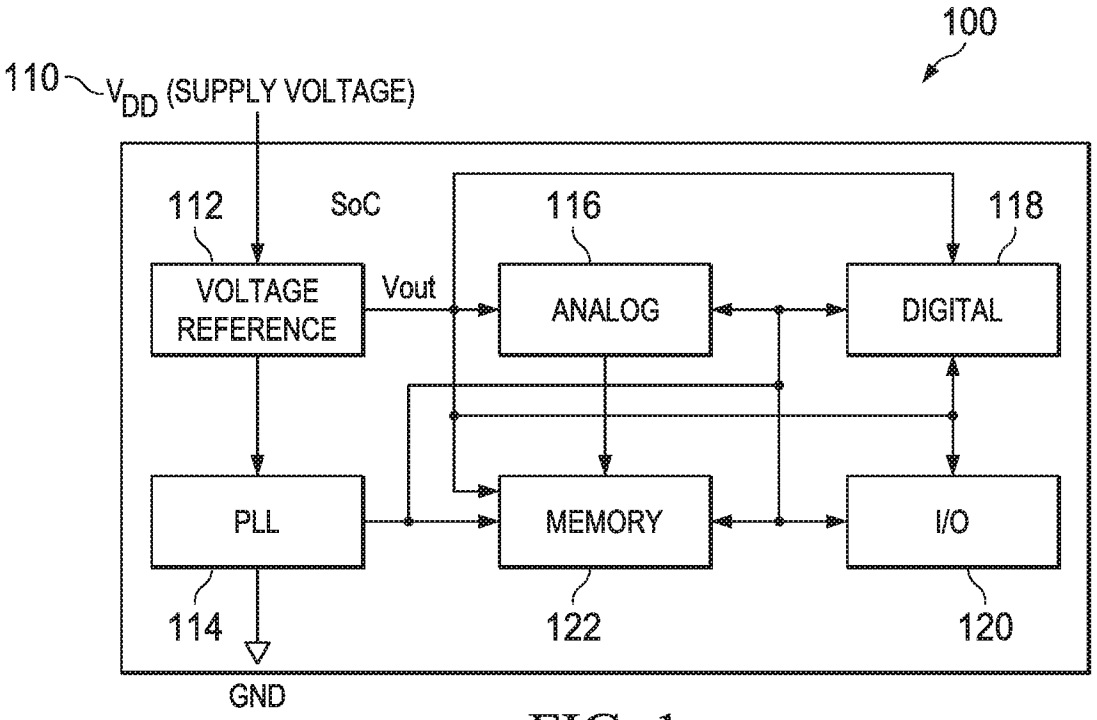
FIG. 1 depicts an exemplary System-On-Chip (SOC) circuit block diagram including a voltage reference circuit, according to an illustrative implementation.

Very-Large-Scale-Integration (VLSI) circuits require stable and predictable voltage references over PVT (Process, supply Voltage, and Temperature) variations. In those cases, a bandgap reference circuit is often used as a primary voltage reference generator to create a temperature independent (or zero temperature slope) voltage reference in a typical System-On-Chip (SOC) implementation. FIG. 1 shows an example circuit block diagram of a typical SOC device incorporating such a voltage reference circuit. The output voltage, $V_{out}$, from the voltage reference circuit is routed to different parts of the SOC. In some applications, however, there is a need for a voltage reference with a specific temperature slope, such as a positive or negative temperature slope instead of a zero temperature slope.

Unfortunately, conventional voltage reference circuits generally do not provide temperature slope control or may suffer from large size and power inefficiencies due to their complexity and large supply requirements. Such issues have been discussed in ISL 21400 Programmable Temperature Slope Voltage Reference Application Note, Intersil, January 2009. Power inefficiencies may result from the use of bipolar transistors in the bandgap circuit of voltage reference circuits. Voltage reference circuits may also generate an output voltage or current with that has a temperature slope that is closely related to an offset, which does not provide an easy way to independently control the temperature slope and offset of the voltage or current reference output. This tight coupling between temperature slope and offset requires significant iteration to find an optimum solution when the temperature slope and the offset need to be controlled precisely to target values. A larger the number of iterations increases test time and the cost of development and manufacturing.

The present disclosure relates to an architecture, apparatus and method to generate an output voltage relative to power supply voltage. The benefit of a voltage reference output relative to the supply voltage is its direct usage in memory cell operation. In some of emerging memory cell technologies, depending on the mode of operation (write, read, or standby modes), the control circuit to operate the memory cell in each mode requires a different voltage level with different temperature slope at a DC level that is relative to power supply. The present disclosure can also relate to an architecture, apparatus, and method to generate an output voltage reference relative to ground.

FIG. 1 depicts an exemplary SOC circuit block diagram including a voltage reference circuit, according to an illustrative implementation. The SOC 100 is shown as an example of the incorporation of the voltage reference circuit 112 into a larger system. The positive supply voltage 110 may power the voltage reference circuit 112. The voltage reference circuit 112 may produce an output voltage reference that is programmable and scales linearly with changes in temperature of the SOC 100, and where a voltage temperature slope change and voltage offset are separately programmable. The output voltage reference may then be coupled to a Phase Lock Loop (PLL) 114, an Analog circuit block 116, a Memory block 122, and/or a Digital block 118, or any combination thereof. The Analog circuit block 116 and Digital circuit block 118 may be in communication with each other. As referred to herein, the term "coupled to" may be understood to refer to directly or indirectly connected to (e.g., through an electrical connection). The output of the PLL circuit block 114 may also be coupled to the Analog circuit block 116, the Digital circuit block 118, the Memory block 122 and/or the Input/Output block (I/O) at 120, or any combination thereof. The I/O block 120 may be in communication with the Digital circuit block 118 and/or the Memory block 122.

The Memory block shown at 122 may be a Dynamic random-access memory (DRAM) cell, a Static random-access memory (SRAM) cell, a Thyristor random-access memory (T-RAM) cell, any other suitable data storage circuit, or any combination thereof. The T-RAM memory cell exploits the negative differential resistance (NDR) behavior of a pnpn thyristor, and may provide high density memory storage. The voltage reference circuit 112 may provide a temperature independent voltage reference to each of the blocks shown in SOC 100. The PLL 114 may then convert the output of the voltage reference circuit 112 to a temperature independent clock signal, which may then be sent to the other blocks 116, 118, 120 and 122 in the SOC 100. The Analog circuit block 116 may amplify the voltage reference circuit 112's signal before sending it to the Digital circuit block 118. For each of the blocks 114, 116, 118, 120 and 122 shown in the SOC, the Voltage Reference circuit 112 provides a temperature independent voltage signal which may be converted or altered as needed by each of the circuit blocks.

Figure 2:
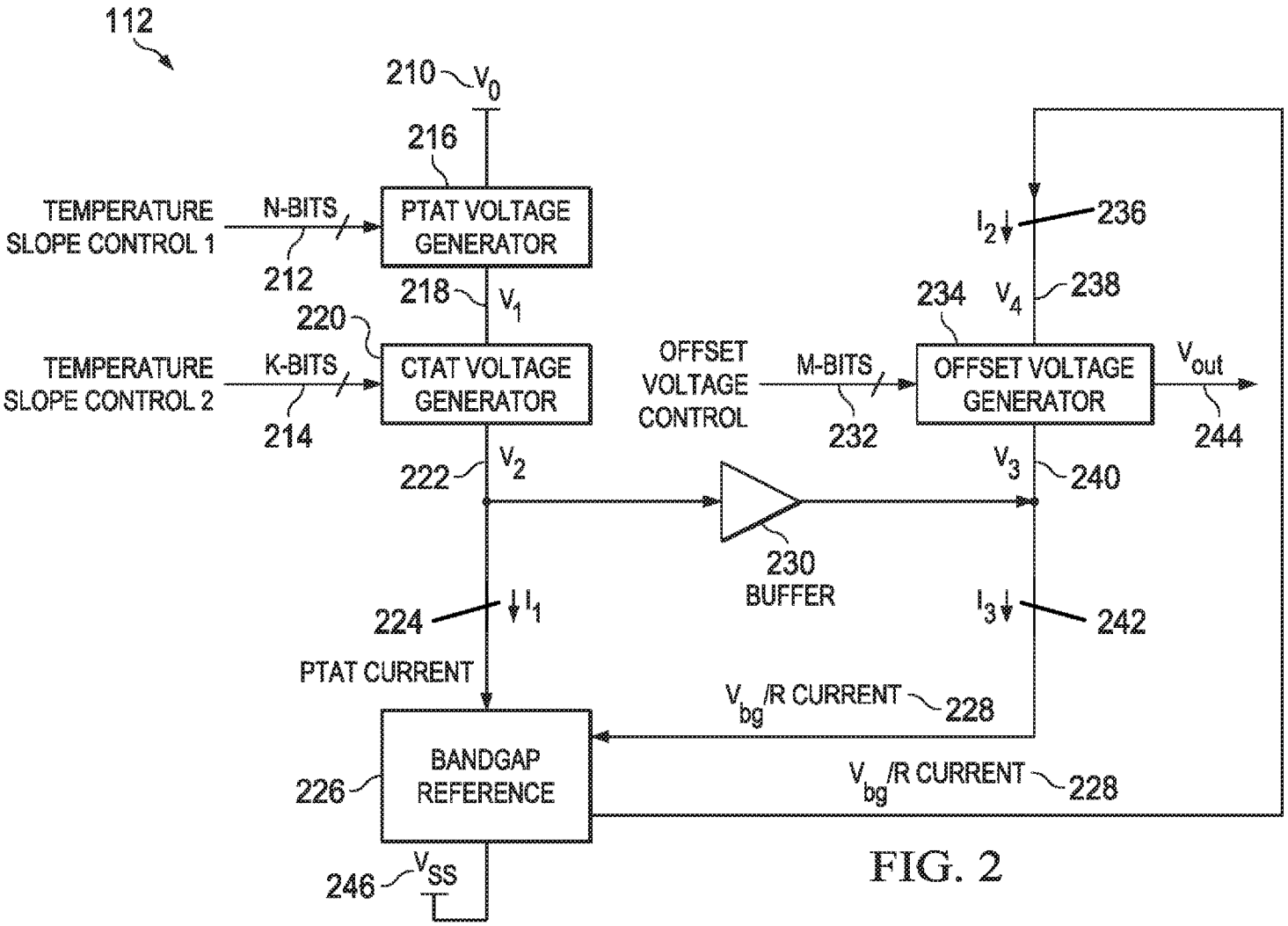
FIG. 2 depicts a circuit block diagram of one embodiment of a voltage reference circuit configured to generate an output voltage having programmable temperature slope and offset controls, according to an illustrative implementation.

FIG. 2 depicts a circuit block diagram of one embodiment of a voltage reference circuit 112 configured to generate an output voltage reference having a programmable temperature slope and offset controls, according to an illustrative implementation. The voltage reference circuit 112 may be powered by input voltage $V_0$ shown at 210. Input voltage $V_0$ 210 may be the positive supply voltage $V_{DD}$ 110 or may be derived from positive supply voltage $V_{DD}$ 110 as shown in FIG. 1. Input voltage $V_0$ may be coupled to a PTAT voltage generator 216, which is programmed with a first set of temperature slope control bits 212. The PTAT voltage generator 216 may be described in further detail with reference to FIG. 5. The PTAT voltage generator may then produce an output voltage $V_1$ 218 that is proportional to the temperature of the SOC 100 as shown in FIG. 1 or any device into which the circuit 112 is incorporated. The output voltage $V_1$218 will thus scale linearly with a positive temperature slope in response to increases in temperature of the SOC 100 as shown in FIG. 1 or a device into which the circuit 112 is incorporated. The first set of programmable temperature control bits 212 may determine the value of the temperature slope of the output voltage $V_1$218. The PTAT voltage generator 216 is described in further detail with reference to FIG. 5.

The PTAT voltage $V_1$ 218 may then be supplied to a CTAT voltage generator 220, which is programmed using a second set of programmable temperature control bits 214. The CTAT voltage generator 220 may be described in further detail with reference to FIG. 6 and FIG. 7. The CTAT voltage generator 220 may then produce an output voltage $V_2$ 222 which is a linear combination of the PTAT voltage $V_1$ 218 and a CTAT voltage produced by the CTAT voltage generator 220. The CTAT voltage will thus scale linearly with a negative temperature slope in response to increases in temperature of the SOC 100 or device into which the circuit 112 is incorporated. The second set of programmable temperature control bits 214 may determine the value of the temperature slope of the CTAT voltage, and, thus, the temperature slope of the output voltage $V_2$ 222 which may be a combination of the PTAT voltage $V_1$ 218 and the CTAT voltage.

Thus a combination of the PTAT voltage generator 216 and CTAT voltage generator 220 produces a voltage $V_2$ 222 with a desired temperature slope by programming the first and second set of programmable temperature control bits 212 and 214, respectively. The voltage $V_2$ 222 is then coupled to a buffer 230, which is coupled to Offset voltage generator 234. Offset voltage generator 234 adjusts the value of the voltage offset to produce output voltage $V_{out}$ 244, which may serve as a voltage reference. Bandgap Reference circuit block 226 has negative supply voltage $V_{ss}$ 246. The Bandgap Reference circuit block 226 produces the PTAT current $I_1$ 224, as well as an output current 228 given by $V_{bg}/R$, where $V_{bg}$ is the bandgap voltage produced by the Bandgap Reference circuit block 226 and R is an adjustable resistance defined by the Bandgap Reference circuit block 226. Examples of Bandgap Reference circuits may be described in further detail in FIG. 4, but may also be any circuit capable of producing a temperature independent voltage output and/or current output. The current 228 may be the same as current $I_2$ 236, which is supplied with voltage $V_4$ 238 into the Offset voltage generator 234. The Offset voltage generator 234 is programmed by programmable offset voltage control bits shown at 232, which determine the voltage offset of the output voltage $V_{out}$ 244. The Offset voltage generator 234 takes the buffer output voltage $V_3$ 240 and then shifts the voltage level by the offset amount defined by the programmable offset voltage before it routs to the output voltage $V_{out}$ 244.

As shown in FIG. 2, the input voltage $V_0$ 210 is first converted to a PTAT voltage $V_1$ 216. However, some implementations may change the order of the PTAT voltage generator 216 and the CTAT voltage generator 220. In this case, $V_0$ 210 would first be converted to a CTAT voltage by the CTAT voltage generator 220. This voltage would then be added to a PTAT voltage produced by the PTAT voltage generator 216, to produce $V_2$ 222 with the desired temperature slope.

Some implementations may first adjust the offset voltage of the input voltage $V_0$ 210 before subsequently adjusting the temperature slope with the PTAT voltage generator 216 and the CTAT voltage generator 220. In this variation, the input voltage to the Offset voltage generator 234 shown in FIG. 2 as $V_4$ 238 would be the drive voltage $V_0$ 210, while the voltage $V_3$ 240 may be derived from the voltage $V_{bg}$ produced by the Bandgap reference 226. $V_3$ 240 could thus be a scalar multiple of $V_{bg}$ or an offset from $V_{bg}$, where said offset is produced by a voltage divider or any other circuit capable of producing a voltage offset (not shown). The output $V_{out}$ 244 of the Offset voltage generator 234 may be connected to the PTAT voltage generator circuit block 216 and the CTAT voltage generator circuit block 220 through an additional buffer (not shown). The buffered $V_{out}$ 244, which would have the desired offset, could then be supplied to the PTAT voltage generator circuit block 216 and CTAT voltage generator circuit block 220 as either $V_0$ 210, $V_1$ 218, or $V_2$ 222. The output voltage in this variation would still have an offset separately controlled by the programmable offset voltage control bits 232, and a temperature slope controlled by the first and second set of programmable temperature control bits 212 and 214, respectively. In any of the cases described above, by virtue of the 2-step process in the architecture shown in FIG. 2, whereby the Offset voltage generator 234 is separate from the PTAT voltage generator circuit block 216 and CTAT voltage generator circuit block 220, the temperature slope and the offset of the voltage reference output can be independently controlled by software programming during a manufacturing test.

Figure 3:
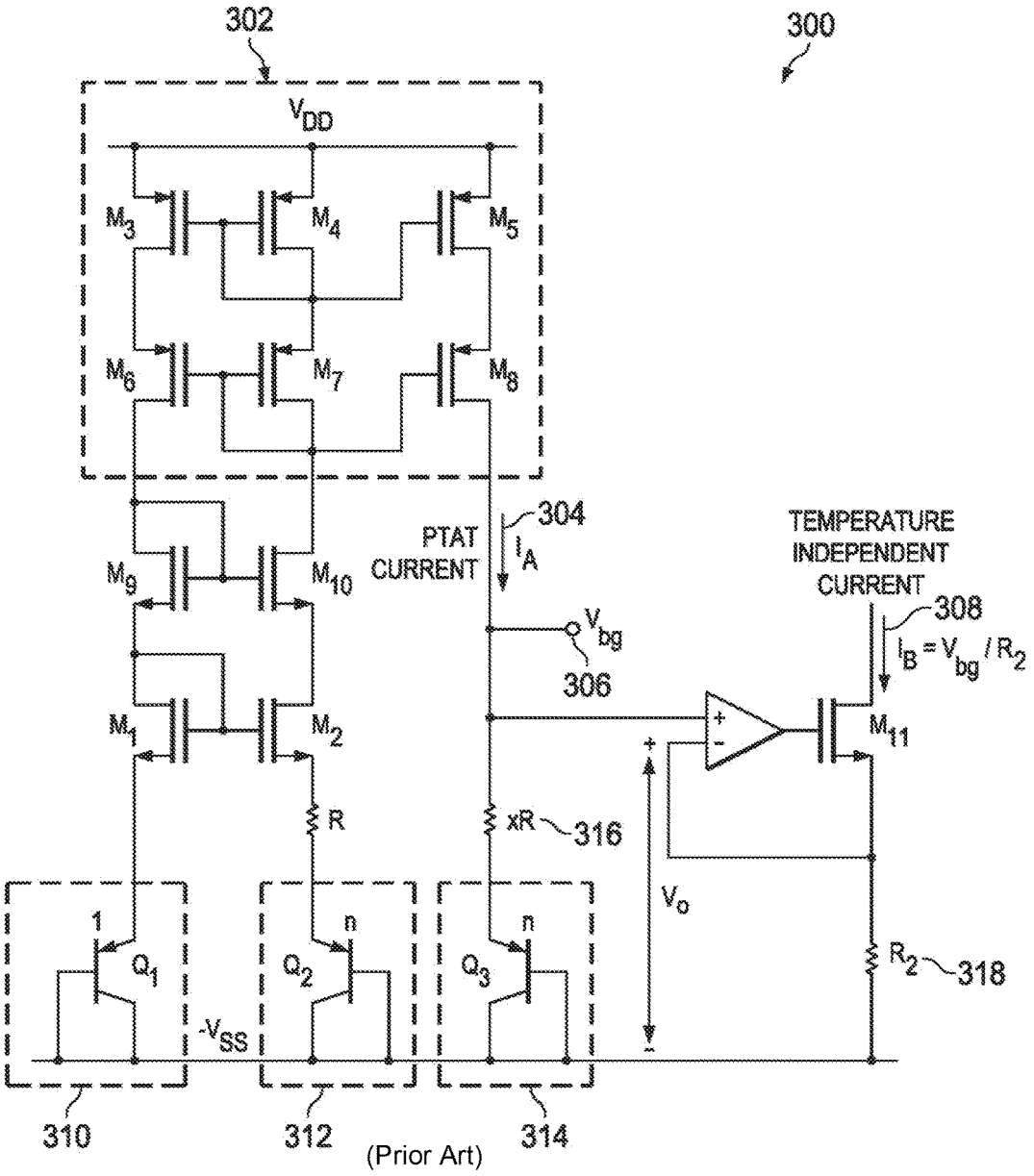
(Prior Art) FIG. 3
FIG. 3 is an exemplary bandgap reference circuit, according to an illustrative implementation.

FIG. 3 is an exemplary bandgap reference circuit, according to an illustrative implementation. Bandgap reference circuits have been described in P. Gray and R. Meyer, "Analysis and Design of Analog Integrated Circuits" pp. 345, John Wiley & Sons, 1993. The bandgap reference circuit 300 produces a temperature independent output current $I_B$ 308, as well as a bandgap voltage $V_{bg}$ 306 and PTAT current $I_A$ 304. Cascode current mirror 302 is added to the circuit 300 to reduce noise from a positive supply voltage, and may be comprised of any field-effect transistors (FETs). Bipolar Junction Transistors (BJTs) are shown at 310, 312 and 314, where 312 and 314 are pnp BJTs. A PTAT current 304 from the cascode current mirror 302 produces a positive temperature dependent voltage drop across resistor 316. The value of x for the resistor 316 may be chosen to cancel the negative temperature dependent voltage developed in pnp BJT 314 to produce a temperature independent bandgap voltage $V_{bg}$ 306.

Figure 4:
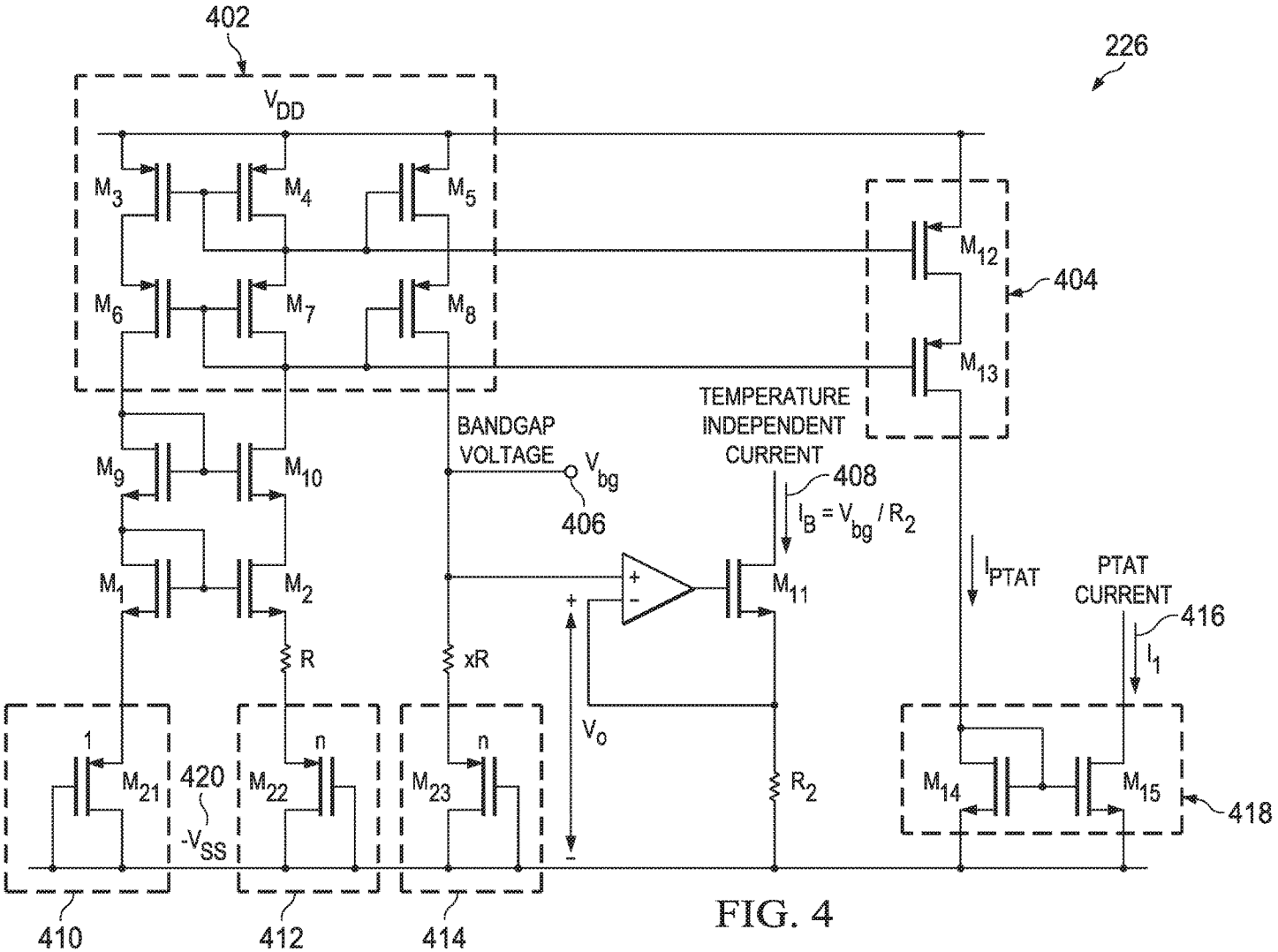
FIG. 4 is an exemplary bandgap reference circuit showing how a Proportional To Absolute Temperature (PTAT) current and temperature-independent current may be generated from a Complementary Metal-Oxide-Semiconductor (CMOS) bandgap voltage reference, according to an illustrative implementation.

FIG. 4 is an exemplary bandgap reference circuit showing how PTAT current and temperature-independent current may be generated from a CMOS bandgap voltage reference, according to an illustrative implementation. The circuit 226 produces a PTAT current $I_1$ 416, a temperature independent current $I_B$ 408 and a bandgap voltage $V_{bg}$ 406. A cascode current mirror 402 reduces noise from the positive supply voltage. CMOS transistors are shown at 410, 412 and 414, where transistors 412 and 414 are PMOS transistors. A negative supply voltage $V_{ss}$ is shown at 420. Additional current mirrors 404 replicate the current from the cascode current mirror 402. NMOS current mirror is shown at 418. The PTAT current $I_1$ 416 is used in the programmable PTAT voltage generator shown in FIG. 2 and FIG. 5. In contrast to the bandgap reference circuit of FIG. 3, the bandgap reference circuit of FIG. 4 uses MOSFETs for transistors 410, 412, and 414, instead of BJTs. MOSFETs may be advantageous over BJTs for applications that require lower voltage and lower layout area.

Figure 5:
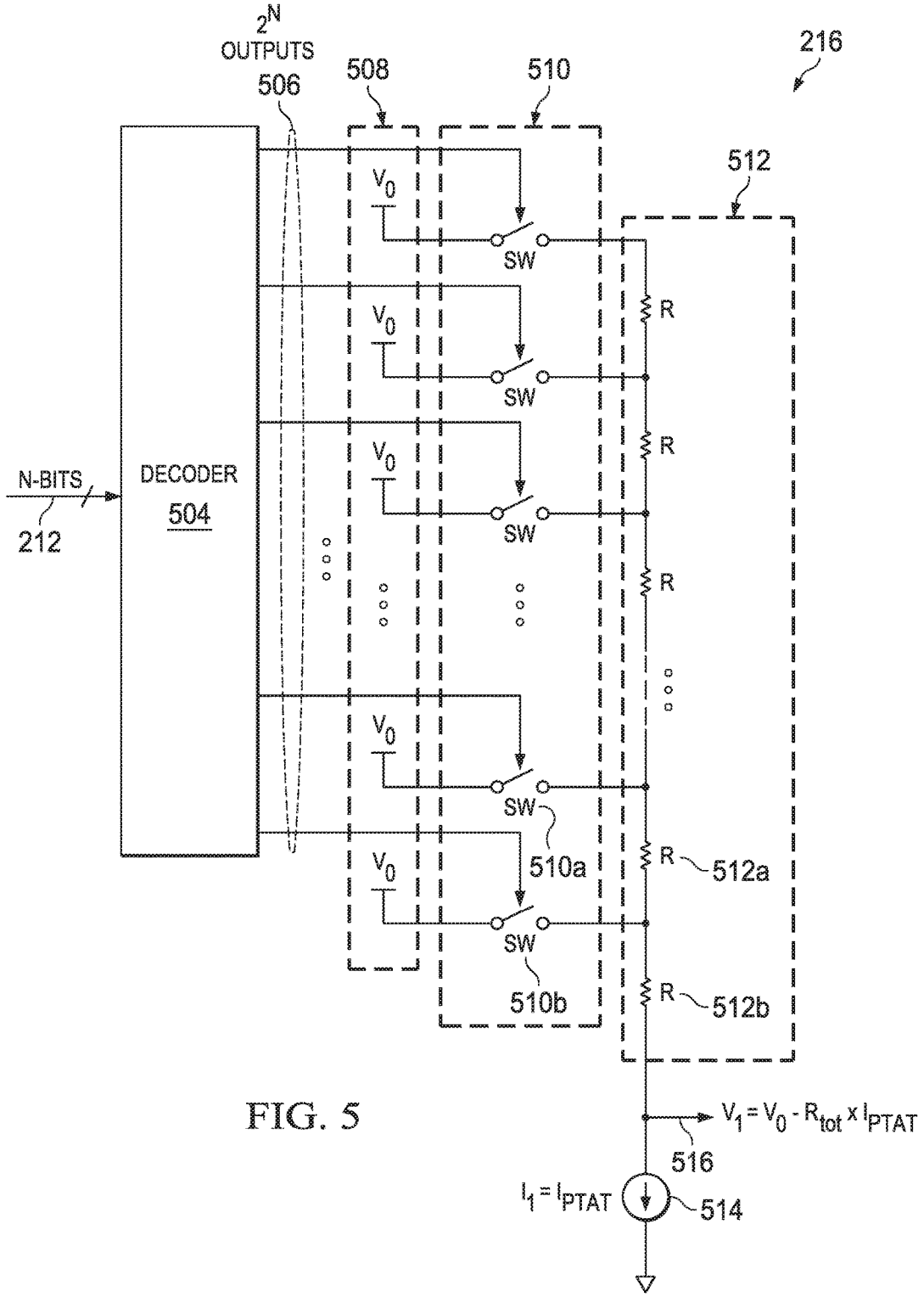
FIG. 5 depicts a programmable PTAT voltage generator using a series of resistors and switches in which a decoder takes a first set of programmable temperature control bit inputs and produces $2^N$ output signals to select one switch in the array, according to an illustrative implementation.

FIG. 5 depicts a programmable PTAT voltage generator using a series of resistors and switches, in which decoder takes the first set of programmable temperature control bits input and produces $2^N$ output signals to select one switch in the array, according to an illustrative implementation. The first set of programmable temperature control bits 212 are input into a decoder 504. The decoder 504 is connected to $2^N$ outputs shown at 506. A single output 516 may be coupled to one input voltage terminal in an array of input voltage terminals 508, by one switch in an array of switches 510 and by one or more resistors in an array of resistors 512. The first set of programmable temperature control bits 212 closes a single switch in the array of switches 510, directing the PTAT current from the input terminal 508 through the resistors 512, producing PTAT voltage 516. This PTAT voltage 516 is determined by the equation:

$$V_1 = V_0 - R_{tot} I_{PTAT} \quad \text{(EQ. 1)}$$

where $R_{tot}$ is the total resistance through which the current $I_{PTAT}$ 514 travels before reaching output node 516. In some implementations, each of the resistors in the array of resistors 512 shown in FIG. 5 has a substantially same resistance value R. For example, the resistance values of each of the array of resistors may be within 10% or less of each other and/or a substantially same resistance value R. For example, the resistance values may be within 5% or less of each other and/or a substantially same resistance value R. For example, the resistance values may be within 0.1% or less of each other and/or a substantially same resistance value R. Because the resistors 512 are in series, $R_{tot}$ will be equal to n*R where n is the integer number of the selected switch starting from the bottom-most output path, and where n varies from 1 to $2^N$. In some implementations, it is also possible to have sections of the array 512 in which the resistor values are not all the same value and may vary, for example, as scalar multiples of each other, or by orders of magnitude. In this case, there may be regions within the outputs 506 of non-linear change in the PTAT voltage as, for example, a switch n is closed and a switch n±1 is opened in the array 510. For example, the resistance of the plurality of resistors may increase as scalar multiples, where resistor 512*b* has a resistance R, and resistor 512*a* has a resistance 2*R, and subsequent resistors have a resistance n*R, where n is an index of the resistor in the plurality of resistors and ranges from 1 to N. For example, the resistance of the plurality of resistors may increase as a geometric series, where resistor 512*b* has a resistance R, and resistor 512*a* has a resistance 2*R, and subsequent resistors have a resistance $2^m$*R, where m is an index of the resistor in the plurality of resistors. For example, the resistance of the plurality of resistors may increase as a geometric series, where resistor 512*b* has a resistance R, and resistor 512*a* has a resistance 10*R, and subsequent resistors have a resistance 10/*R, where j is an index of the resistor in the plurality of resistors. In these implementations, a wider range of resistance values and temperature slopes may be covered, than by using a linear increase in resistance. In some implementations, segments of the resistors may change in value. For example, the first five resistors of resistors 512 may have a resistance R, and the next five resistors of resistors 512 may have a resistance 10*R, and the subsequent five resistors of the resistors may have a resistance $10^2$*R. In these implementations, a wider range of resistance values and temperature slopes may be covered, with fine tuning available within respective segments of resistors having the same resistance.

As an example, if the first set of programmable temperature control bits 212 close the bottom-most switch 510*b*, current will run through switch 510*b* and resistor 512*b*. All other outputs in the array will be turned "off". The effective resistance $R_{tot}$ will then be equal to R since the current travels through the single resistor 512*b*, producing an output voltage $$V_1=V_0-RI_{PTAT} \quad \text{(EQ. 2)}$$

If the first set of programmable temperature control bits closes the switch 510*a*, then current will run through switch 510*a*, resistor 512*a* and resistor 512*b*. Thus, the effective resistance $R_{tot}$ will be 2*R, producing an output PTAT voltage given by $$V_1=V_0-2RI_{PTAT} \quad \text{(EQ. 3)}$$

As can thus be appreciated, the minimum temperature slope will correspond to the selection of switch 510*b*, and the temperature slope will increase as switches are selected further up the array 510 from switch 510*b*. The first set of programmable temperature control bits 212 will adjust the temperature slope of the output voltage by changing the selected switch. The first set of programmable temperature control bits 212 may default to selecting the middle switch, and adjusting up or down in the array of switches 510 to reach the target temperature slope. The first set of programmable temperature control bits 212 may also default to selecting the bottom-most switch 510*b* corresponding to the minimum temperature slope and gradually increasing the temperature slope by moving up in the array of switches 510. The first set of programmable temperature control bits 212 may also default to selecting the top-most switch corresponding to the maximum temperature slope and gradually decreasing the temperature slope by moving down in the array of switches 510. As the temperature coefficient of the resistor string has substantially weak temperature dependency compared to the PTAT current, the overall voltage developed across the resistor string, $V_0$-$V_1$, has positive temperature characteristics, $\alpha R \times I_{PTAT}$, where a varies from 1 to $2^N$ depending on the selected switch position from the decoder. The $V_0$ level shown in the input terminal array 508 in FIG. 5 is a positive supply voltage $V_{DD}$ in an implementation, but could be an arbitrary voltage level if driven by a low drop-out (LDO) regulator or an amplifier such as a source follower. It is important to maintain the on-resistance of the switch relatively small compared to the resistor R to reduce the nonlinear effect from the switch resistance.

Figure 6:
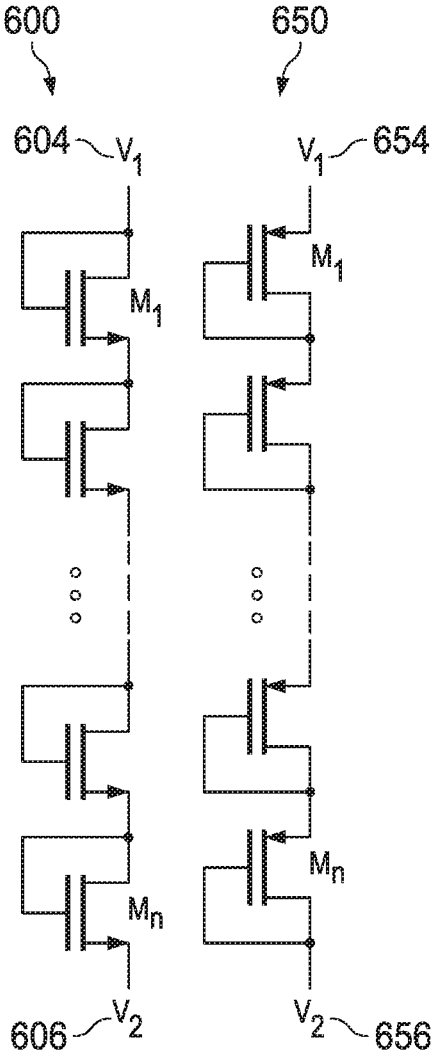
FIG. 6 depicts one embodiment of a Complementary To Absolute Temperature (CTAT) voltage generator using a multitude of (a) NMOS transistors, and (b) PMOS transistors, according to an illustrative implementation.

FIG. 6 depicts one embodiment of a CTAT voltage generator using a multitude of NMOS transistors or PMOS transistors, according to an illustrative implementation. NMOS transistors 600 and PMOS transistors 650 are both a type of field-effect transistor (FET). As shown at 600, an input voltage $V_1$ 604 may pass through a series of x NMOS transistors, resulting in output voltage $V_2$ 606. The input voltage $V_1$ may be the output voltage of the PTAT voltage generator circuit block 216, meaning that it may be proportional to temperature. The drain-source voltage of each of the x NMOS transistors will decrease with temperature, producing a CTAT voltage. Thus, as $V_1$ travels through each of the x NMOS transistors, its temperature slope may become increasingly negative as the CTAT voltage is added to the input $V_1$ voltage 604. The output $V_2$ 606 may thus be a combination of the input $V_1$ voltage 604 and a CTAT voltage produced by the voltage drop across each of the x NMOS transistors.

Similarly, as shown in 650, an input voltage $V_1$ 654 may pass through a series of x PMOS transistors, resulting in output voltage $V_2$ 656. The input voltage $V_1$ 654 may be the output voltage of the PTAT Voltage generator circuit block 216, meaning that it may be proportional to temperature. The source-gate voltage of each of the x PMOS transistors will decrease with temperature, producing a CTAT voltage. Thus, as $V_1$ travels through each of the x PMOS transistors, its temperature slope may become increasingly negative as the CTAT voltage is added to the input $V_1$ voltage 654. The output $V_2$ 656 may thus be a combination of the input voltage 654 and a CTAT voltage produced by the voltage drop across each of the x PMOS transistors.

Depending on the process option (such as deep n-well) available for the design, once can choose either the series of x NMOS transistors shown at 600 or the series of x PMOS transistors shown at 650 to trade-off cost, size, and performance. By utilizing the exponential characteristics of the MOS transistors shown at both 600 and 650 in their sub-threshold region, substantially linear negative temperature characteristics of around −2 mV/° C. can be achieved similar to bipolar base-emitter junction characteristics.

For both the NMOS transistors 600 and the PMOS transistors 650, the CTAT voltage contribution of each of the transistors in the array 600 and 650 will be defined by the length and width parameters of the gate of the transistor. If each of the transistors in the array 600 has the same ratio of length to width, then moving up or down in the array 600 will result in linear changes to the CTAT voltage. The same is true for the array 650. However, it is also possible to include a subset of transistors within the array 600 for which the ratio of length to width is different, meaning the $x^{th}$ transistor in the subset may have a different length to width ratio than the x±1th transistor. In this case, moving up or down in the subset of the array may result in non-linear changes to the CTAT voltage. The same is true for the array 650.

Figure 7:
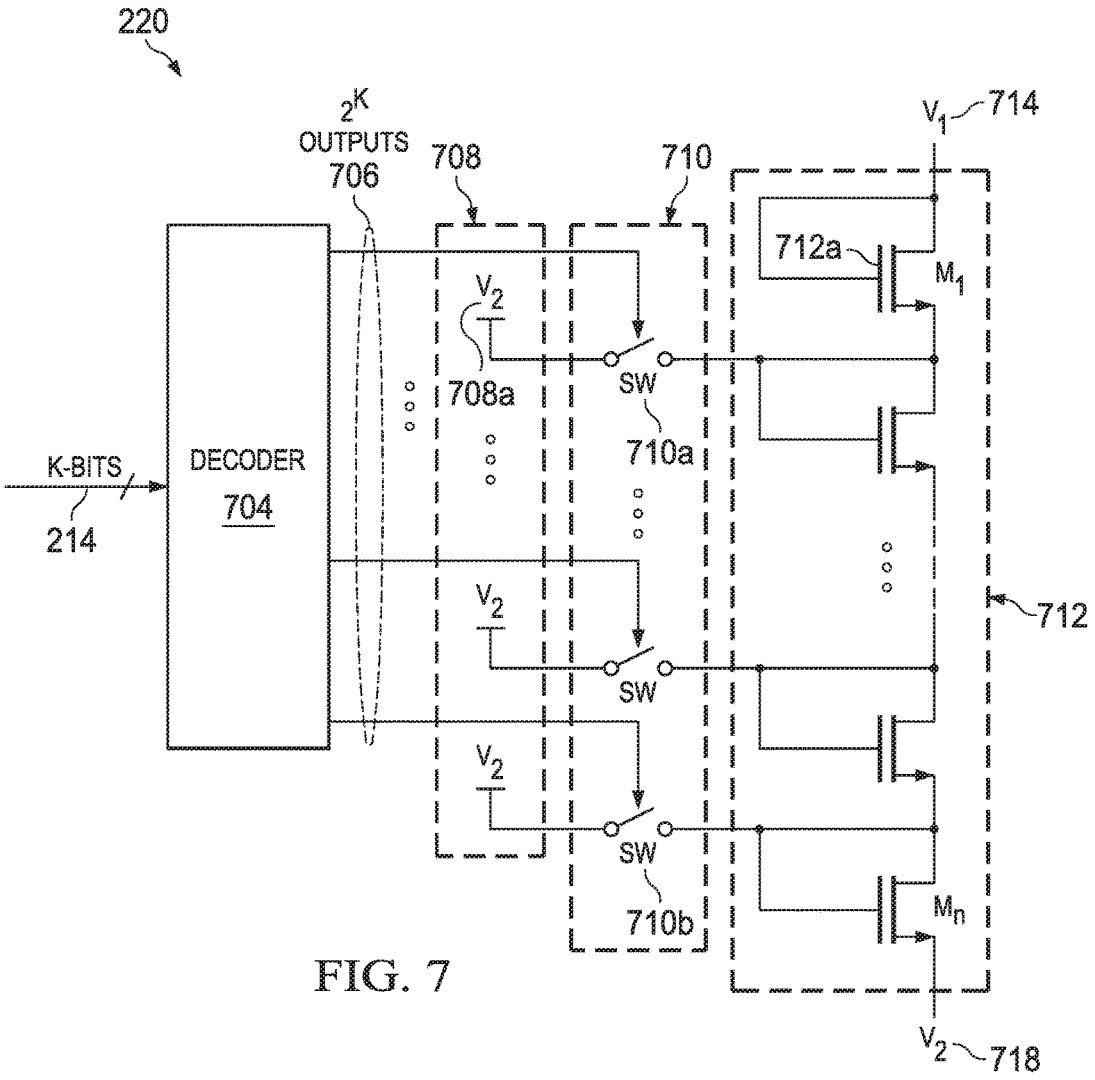
FIG. 7 depicts another embodiment of a CTAT voltage generator using a multitude of NMOS transistors, switches, and a decoder to create a programmable CTAT voltage, according to an illustrative implementation.

FIG. 7 depicts another embodiment of a CTAT voltage generator using a multitude of NMOS transistors, switches, and a decoder to create a programmable CTAT voltage, according to an illustrative implementation. Thus, the circuit 220 shown in FIG. 7 depicts an embodiment of a programmable CTAT voltage generator by adding a series of switches and a decoder on top of the structure 600 or 650 as shown in FIG. 6. A second set of programmable temperature control bits 214 are input into a decoder 704. The decoder 704 is connected to $2^K$ outputs 706. A single output $V_2$ may be connected to each of an array of output voltage terminals 708, switches 710, and Metal-oxide-semiconductor-field-effect (MOSFET) transistors 712, which are shown in FIG. 7 as NMOS transistors, but may also be an array of PMOS transistors as shown at 650 in FIG. 6. The second set of programmable temperature control bits 214 closes a single switch in the array of switches 710, directing the PTAT voltage $V_1$ from the input terminal 714 through the transistors 712, producing a linear combination of the PTAT voltage $V_1$ 714 and a CTAT voltage produced by the transistors 712. This voltage is output at 718 and/or 708 as $V_2$.

As an example, if the second set of programmable temperature control bits 214 closes none of the switches in the array of switches 710, then the input PTAT voltage $V_1$ 714 will travel through all of the x transistors in the array of MOSFET transistors 712. In this example, the output voltage $V_2$ will be at 718. In this case, where none of the switches are closed, the CTAT voltage generator circuit block 220 will maximally reduce the temperature slope of the input PTAT voltage $V_1$, since the PTAT voltage $V_1$ will be directed through the maximum number of transistors in the array 712 which each produce a CTAT voltage drop. Thus, as each switch is closed in the array of switches 710, the CTAT voltage contribution to the output temperature slope will be reduced. In another example, if the second set of programmable temperature control bits 214 closes the switch 710*a*, then the voltage $V_1$ will travel from 714 through only the first transistor 712*a*, and will be output at the top output node 708*a* as $V_2$. This example will give the minimum contribution of CTAT voltage to the combined PTAT and CTAT voltage $V_2$. As switches are closed further down the array of paths from the top path shown by 708*a*, 710*a* and 712*a*, the contribution of the CTAT voltage will be gradually increased, and, thus, the temperature slope of the output voltage $V_2$ 708 and 718 will be decreased. The second set of programmable temperature control bits 214 may default to selecting the bottom-most switch 710*b* corresponding to the minimum temperature slope (e.g., most negative temperature slope) and gradually increasing the temperature slope by moving up in the array of switches 710. The second set of programmable temperature control bits 214 may also default to selecting the top-most switch 710*a* corresponding to the maximum temperature slope (e.g., least negative temperature slope) and gradually decreasing the temperature slope by moving down in the array of switches 710. The second set of programmable temperature control bits 214 may also default to selecting a middle switch in the array of switches 710, and moving either up or down in the array to decrease or increase the temperature slope of the output voltage $V_2$ 708 and 718.

The transistors in the array of MOSFET transistors 712 may each have a substantially same gate width and a substantially same gate length. For example, the gate widths and gate lengths may be within 10% or less of each other. For example, the gate widths and gate lengths may be within 5% or less of each other. For example, the gate widths and gate lengths may be within 1% or less of each other.

Figure 8:
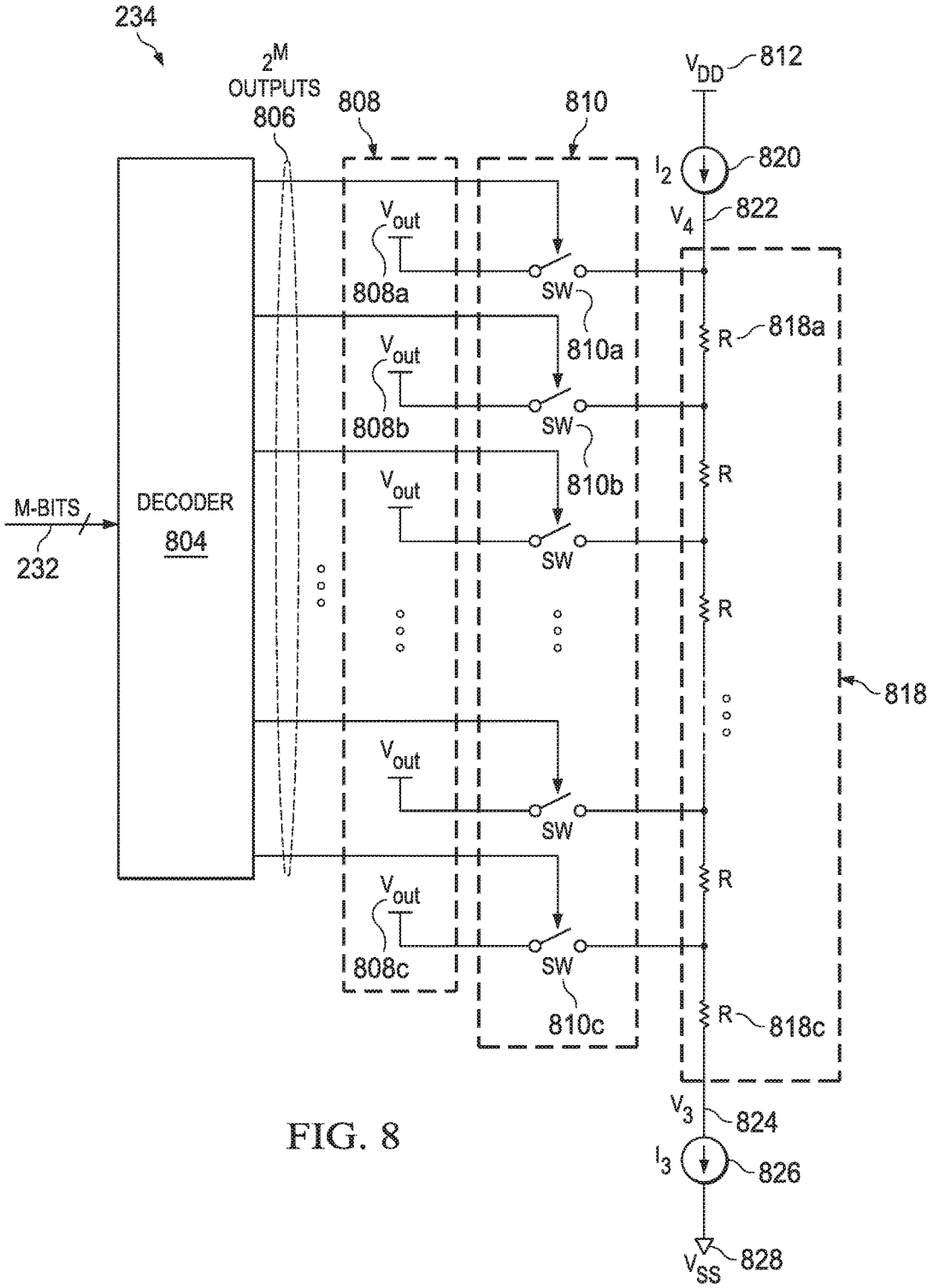
FIG. 8 depicts one embodiment of a programmable offset voltage generator using a series of resistors, switches, decoder, and current sources, according to an illustrative implementation.

FIG. 8 depicts one embodiment of a programmable offset voltage generator using a series of resistors, switches, decoder, and current sources, according to an illustrative implementation. This circuit 234 will adjust the voltage offset of the buffered output voltage $V_3$ 824 of both the PTAT voltage generator 216 and the CTAT voltage generator 220 as shown in FIG. 2. Programmable offset voltage control bits 232 are directed to a decoder 804, which produces $2^M$ possible outputs 806. Each output corresponds to a path in the arrays 808, 810 and 818, where each path has a single output terminal in the array of output terminals 808, a switch in the array of switches 810, and an associated resistor in the array of resistors 818. Currents $I_2$ 820 and $I_3$ 826 are both derived from the Bandgap reference circuit block 226 and its output current $I_B$ 408, and may be scalar multiples of $I_B$ 408 as shown in FIG. 4. As the currents $I_2$ 820 and $I_3$ 826 are derived from temperature independent current $I_B$ 408, this current across the array of resistors 818 creates a temperature independent voltage $V_{out}$ 808 that is used as the programmable offset correction. The negative supply voltage $V_{ss}$ is shown at 828.

As an example, if the programmable offset voltage control bits 232 close the bottom-most switch 810*c*, current will run through switch 810*c* and all other switches in the array 810 will be turned "off" In this example, the offset voltage of the combined PTAT and CTAT voltages $V_3$ 240 as shown in FIG. 2 may be changed by IR drop of the single resistor 818*c*, so that $V_{out}$ 808*c* may produce minimum offset from the voltage $V_3$ 824. In another example, if the programmable offset voltage control bits 232 close the top-most switch 810*a* from the top of the array 810, current will flow through all resistors in the array 818 before reaching the output node 808*a*. The effective resistance $R_{tot}$ will then be equal to $2^M$*R and the voltage $V_{out}$ 808*a* will have the maximum offset from the voltage $V_3$ 824.

As shown in FIG. 8, the resistors in the array of resistors 818 are each shown as having resistance R. As the programmable offset voltage control bits 232 open and close switches in the array of switches 810, the voltage offset will change linearly. However, it is also possible to have resistance values that are scalar multiples of each other, or orders of magnitude of each other, meaning that there could be regions within the array in which moving from switch n to switch n±1 produces a non-linear change in the offset voltage. The variations discussed in reference to FIG. 5 could apply here.

As can thus be appreciated, the minimum voltage offset will correspond to the selection of switch 810*c*, and the offset will increase as switches are selected further and further up the array 810 from switch 810*c*, with the maximum voltage offset corresponding to switch 810*a*. The programmable offset voltage control bits 232 may default to selecting the middle switch, and adjusting up or down in the array to reach the target voltage offset. The programmable offset voltage control bits 232 may also default to selecting the bottom-most switch 810*c* corresponding to the minimum voltage offset and gradually increasing the voltage offset by moving up in the array of switches 810. The programmable offset voltage control bits 232 may also default to selecting the top-most switch 810*a* corresponding to the maximum voltage offset and gradually decreasing the voltage offset by moving down in the array of switches 810.

Figure 9:
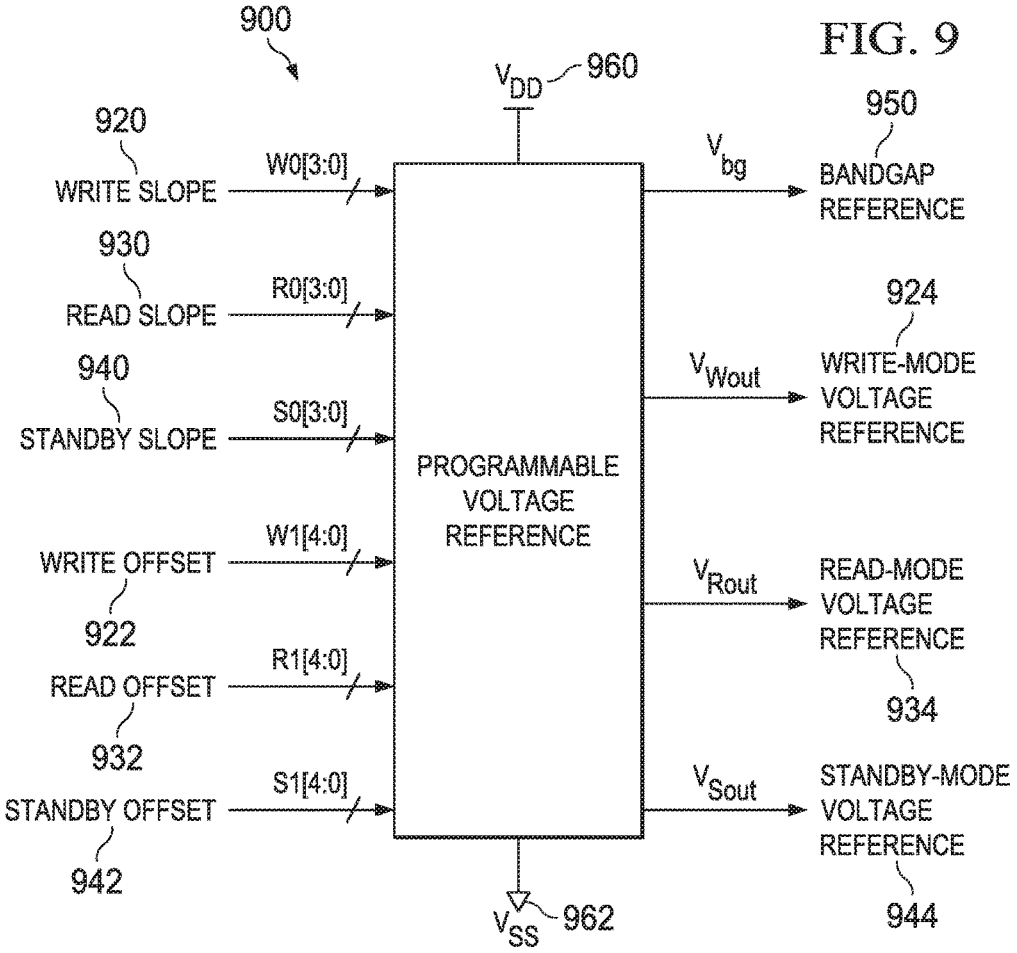
FIG. 9 depicts a top level circuit block diagram of a voltage reference circuit block with programmable input trim bits for write, read, and standby voltage references, and corresponding output voltage references along with a bandgap voltage reference output, according to an illustrative implementation.

FIG. 9 depicts a top level circuit block diagram of the Voltage Reference with programmable input trim bits for write, read, and standby modes, and corresponding output voltage references along with Bandgap voltage reference output, according to an illustrative implementation. The circuit block diagram 900 represents three implementations of the circuit shown at FIG. 2, where the write slope 920, write offset 922 and write-mode voltage reference 924 are associated values from one implementation of the circuit diagram shown at FIG. 2. Read slope 930, Read offset 932 and Read-mode voltage reference 934 are all associated values from a second implementation of the circuit diagram shown at FIG. 2. Standby slope 940, Standby offset 942 and Standby-mode voltage reference 944 are all associated values from a third implementation of the circuit diagram shown at FIG. 2. Each of the three circuits (not shown) may have the same Bandgap Reference circuit 226, and, thus, the Bandgap reference 950 may be from the single Bandgap reference circuit 226 shown in FIG. 4. The positive supply voltage $V_{DD}$ 960 and negative supply voltage $V_{SS}$ 962 are the same for each of the three voltage reference circuits. Thus, each of the voltages 920, 922, 924, 930, 932, 934, 940, 942 and 944 will be measured from either the positive supply voltage $V_{DD}$ 960 or the negative supply voltage $V_{SS}$ 962, which may allow the circuit 900 to operate a memory cell, for example from memory 122 shown in the circuit block diagram 100 of FIG. 1. Circuit block diagram 900 shows three sets of voltage references to produces 3 different temperature slopes and offsets corresponding to programmable input trim bits for slopes (920, 930 and 940) and offsets (922, 932 and 942) for write, read, and standby modes of operation, respectively. The Bandgap reference $V_{bg}$ 950 will remain unchanged in response to fluctuations in the temperature of the circuit block diagram 900 or its associated environment.

Figure 10:
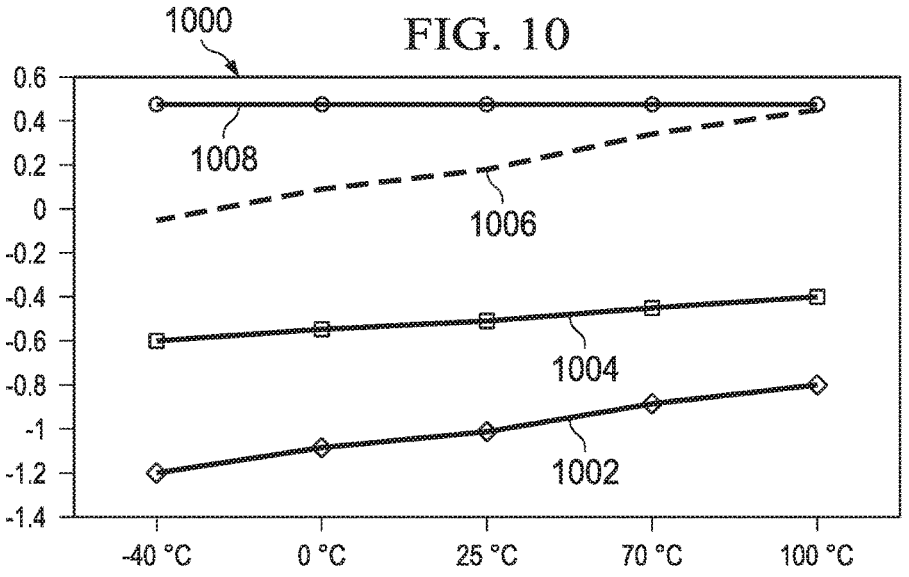
FIG. 10 shows simulation results of voltage references over a temperature range from −40° C. to 100° C. for write, read, and standby voltage references. Also plotted is a bandgap voltage reference showing zero temperature dependence over temperature, according to an illustrative implementation.

FIG. 10 shows simulation results of voltage references over the temperature range from −40° C. to 100° C. for write, read, and standby modes. The present disclosure may be based on the operating temperature range from −40° C. to 100° C. The outputs 1002, 1004 and 1006 may be the outputs 924, 934 and 944 of the Programmable Voltage Reference 900 as shown in FIG. 9. Also plotted is a bandgap voltage 1008, showing the temperature independence of this output. This output may be the voltage output $V_{bg}$ 406 as shown in FIG. 4. The simulation results shown in graph 1000 may be based on $V_{DD}$=1.2V supply voltage to support the memory bit cell operation, such as for the memory block 122 shown in FIG. 1. This memory block 122 may require control voltages with a different temperature slope and offset for each mode (such as read, write and standby) with the DC voltage level relative to the positive supply voltage $V_{DD}$ 110, as shown in FIG. 1.

Figure 11:
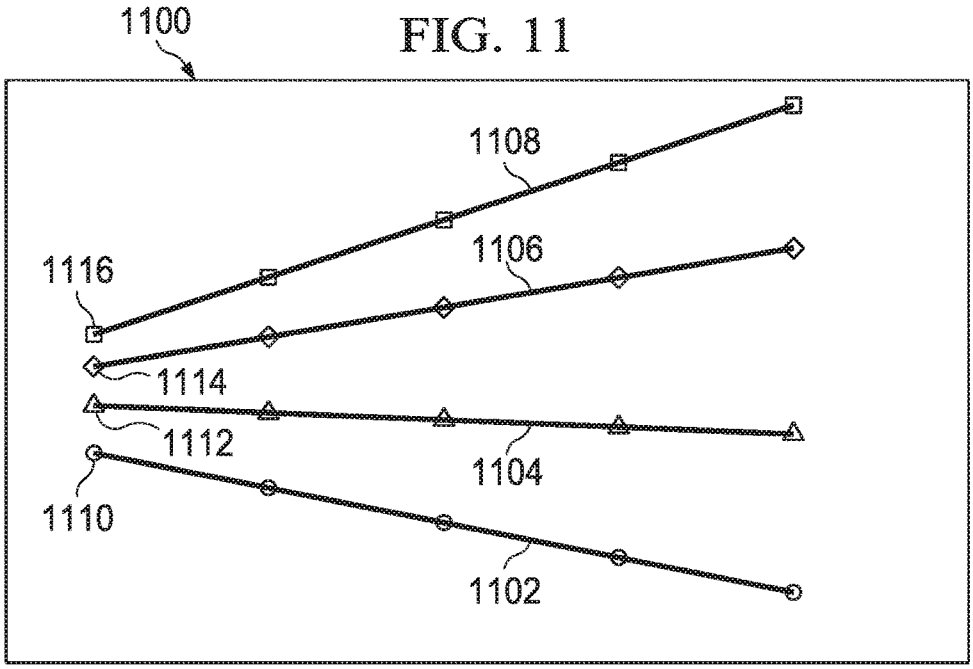
FIG. 11 depicts a graph showing four possible outputs of a voltage reference circuit, each with a different temperature slope, according to an illustrative implementation.

FIG. 11 is a plot showing the programmability of the temperature slope for the voltage reference in a single mode. This may be the write, read or standby mode corresponding to the output voltages 924, 934 and 944 respectively, as shown in FIG. 9. By sweeping the slope trim bits 920, 930 or 940, the temperature slope can be programmed. As shown at 1100, the voltage reference may have many difference slopes and many different offsets. Temperature slopes shown for output voltages 1102, 1104, 1106, 1108 may range from positive to negative temperature slopes with varying degrees of steepness. The temperature slopes 1102, 1104, 1106 and 1108 may be the result of changes to the first set of programmable temperature control bits 212, or the second set of programmable temperature control bits 214 as shown in FIG. 2. The offsets 1110, 1112, 1114, and 1116 may be separately chosen from the values of the temperature slopes shown at 1102, 1104, 1106 and 1108. The offsets may be the result of changes to the programmable offset voltage control bits 232. In an application requiring a larger positive temperature slope, or in an application requiring a negative temperature slope than achievable through adjusting any of the control bits 212, 214 or 232, one can modify the value of the components (the R values of the array of resistors 512 and the PTAT current $I_1$ 514 in FIG. 5, the number of transistors in FIG. 6 in addition to the control bits 212, 214 or 232 to achieve the desired temperature slope.

Figure 12:
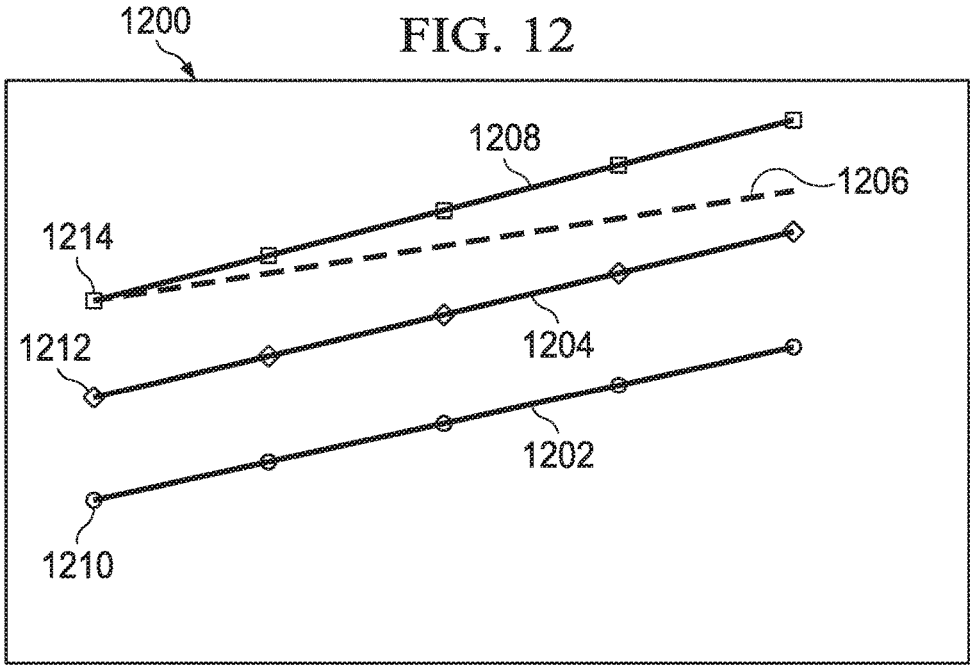
FIG. 12 depicts a graph showing three illustrative outputs of a voltage reference circuit, each with a different offset, according to an illustrative implementation.

FIG. 12 depicts a graph showing three illustrative outputs of a voltage reference circuit, each with a different offset, according to an illustrative implementation. The graph 1200 may show the result of adjusting the programmable offset voltage control bits 232 of the Voltage Offset Reference circuit block 234 as described in further detail in FIG. 2 and FIG. 8. As the Voltage Offset Reference circuit block 234 adjusts the voltage offset, the output, which may be $V_{out}$ 244, may change from plot 1202 to plot 1204, with the same temperature slope and an increase in the offset from 1210 to 1212. In some implementations, while adjusting the offset from 1212 to 1214, for example, the temperature slope of the output voltage reference may change from 1204 to 1206. In this case, it may be necessary to adjust the first set of programmable temperature control bits 212 and/or the second set of programmable temperature control bits 214 to the PTAT and/or CTAT voltage generators 216 and 220 respectively, to maintain the same temperature slope. After adjustment, the output of the voltage generator may change from the output 1206 to 1208, for example, meaning that the temperature slope has been maintained while adjusting the voltage offset of the output voltage 244 from 1212 to 1214.

FIG. 13 shows simulation results of a programmable voltage reference with an extended temperature range from −60° C. to 130° C. in read mode, according to an illustrative implementation. Graph 1300 shows a simulation result of a programmable voltage reference with extended temperature range in read mode. Output 1302 may also be the write or standby modes. Output 1302 may be the outputs 924, 934, or 944 as shown in FIG. 9, or any of the voltage outputs described herein. In the outside of the designed temperature range (which may be from −40° C. to 100° C.), the voltage reference output 1302 exhibits gradual tail characteristics showing there is no abrupt malfunction of the circuit architecture in the present disclosure.

FIG. 14 depicts a flowchart of a process for generating the desired temperature slope and offset the voltage reference output, according to an illustrative implementation. The process of FIG. 14 may be executed by a processor, microcontroller, or other circuitry (e.g., of an external test equipment, or on chip test circuitry that may be located on the same chip, or in a same package, or any combination thereof) configured to execute the process of FIG. 14 (not shown). The process 1400 begins at 1402, where the integrated circuit that includes the programmable voltage reference is manufactured. This integrated circuit may the SOC 100 shown in FIG. 1. At 1404, a processor may set default codes for the temperature slope and programmable offset voltage control bits, which may be set to 1000 corresponding to the middle switch in the array of switches (e.g., of the switches illustrated in FIG. 5, FIG. 7 and/or FIG. 8). 1404 may correspond to setting the first set of programmable temperature control bits 212, the second set of programmable temperature control bits 214, and the programmable offset voltage control bits 232 as shown in FIG. 2. At 1406, the temperature slope and offset of the voltage reference output that results from the default code set in 1404 are measured, for example, by the processor. 1406 may correspond to measuring the voltages $V_1$ 218, $V_2$ 222 and/or $V_{out}$ 244 as shown in FIG. 2. At 1410, the result of this measurement is compared to the target range, and it is determined whether the temperature slope is within this target range. The target range may be specified by design requirements for any one of the PLL 114, the Analog circuit block 116, the Digital circuit block 118, the Memory block 122 and/or the I/O block 120 as shown in FIG. 1. The target range may be determined, and the comparison may be made by a processor, microcontroller, or other circuitry (e.g., of an external test equipment, or on chip test circuitry) configured to execute the process of FIG. 14 (not shown). If the temperature slope is in the target range, the process 1400 goes through path **1410*b* and will then adjust the offset of the voltage reference at 1416. Adjusting the offset of the voltage reference output may be described in further detail with reference to FIG. 16. Adjusting the offset of the voltage reference output may, for example, correspond to moving from output 1202 to output 1204, as shown in FIG. 12. In the event that the temperature measured at 1406 is determined at 1410 to not be within the target range, then the process 1400 follows path 1410*a* and a processor may adjust the control bits to the PTAT voltage generator and/or the CTAT voltage generator at 1412. Adjusting the control bits to the PTAT voltage generator and/or the CTAT voltage generator may correspond to changing the first set of programmable temperature control bits 212 and/or the second set of programmable temperature control bits 214 as shown in FIG. 2**. Once this adjustment is made, the process will return to 1406. This will repeat until the temperature slope is within the target range and the offset has been adjusted at 1416. The iteration process to reach the target value for the temperature slope and offset is generally to go through path 1410*a* before going through path 1410*b*. Typical simulation results show that, once 1412 is complete and the temperature slope is in target range, the process 1400 will then enter into path 1410*b* and does not go through 1412 again, showing independent control of the temperature slope and offset.

Figure 15:
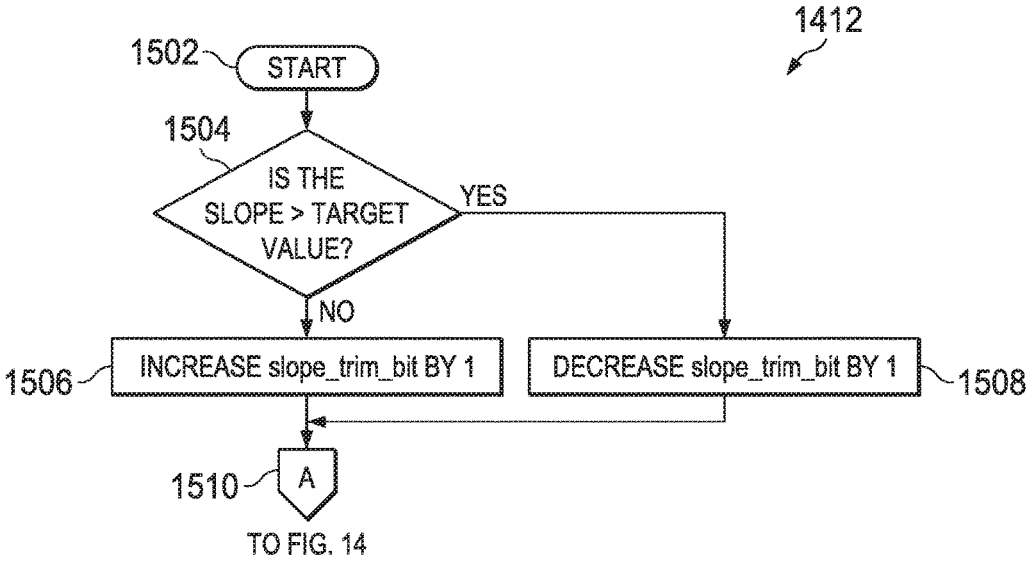
FIG. 15 depicts a flowchart of a process for generating the desired temperature slope of the voltage reference output, according to an illustrative implementation.

FIG. 15 depicts a flowchart of a process for generating the desired temperature slope of the voltage reference output, according to an illustrative implementation. The process of FIG. 15 may be executed by a processor, microcontroller, or other circuitry (e.g., of an external test equipment, or on chip test circuitry that may be located on the same chip, or in a same package, or any combination thereof) configured to execute the process of FIG. 15 (not shown). Process 1412 begins at 1502. From here, it is determined at 1504 if the temperature slope of the voltage reference is greater than the target temperature slope value. The target temperature slope value may be determined by, and the comparison may be made by, a processor, microcontroller, or other circuitry (e.g., of an external test equipment, or on chip test circuitry) configured to execute the process of FIG. 15 (not shown). If the temperature slope is less than the target temperature slope value, the processor may proceed to 1506, where it increases the temperature slope trim bit by one. 1506 may correspond to a processor increasing the first set of programmable temperature control bits 212 and/or the second set of programmable temperature control bits 214, as shown in FIG. 2, by one. Since, in this case, the temperature slope is less than the target temperature slope value, to increase the temperature slope, one may either increase the contribution of the PTAT Voltage generator 216 to the output voltage $V_{out}$ or one may decrease the contribution of the CTAT Voltage generator 220 to the output voltage $V_{out}$ 244. The former will correspond to a change in the first set of temperature control bits 212, whereas the latter will correspond to a change in the second set of temperature control bits 214.

Then, the process 1412 will, at 1510, go back to process A, where process A is associated with 1406, as shown in FIG. 14. If, at 1504, a processor determines that the temperature slope is greater than the target temperature slope value, then the process 1412 will proceed to 1508, in which a processor may decrease the temperature slope trim bit by one. 1506 may correspond to a processor decreasing the first set of programmable temperature control bits 212 and/or the second set of programmable temperature control bits 214, as shown in FIG. 2, by one. Since, in this case, the temperature slope is greater than the target temperature slope value, to reduce the temperature slope, one may either reduce the contribution of the PTAT Voltage generator 216 to the output voltage $V_{out}$, 244, or one may increase the contribution of the CTAT Voltage generator 220 to the output voltage $V_{out}$, 244. The former will correspond to a change in the first set of temperature control bits 212, whereas the latter may correspond to a change in the second set of temperature control bits 214. Then, process 1412 will also go back to process A, where process A is associated with 1406, as shown in FIG. 14.

Figure 16:
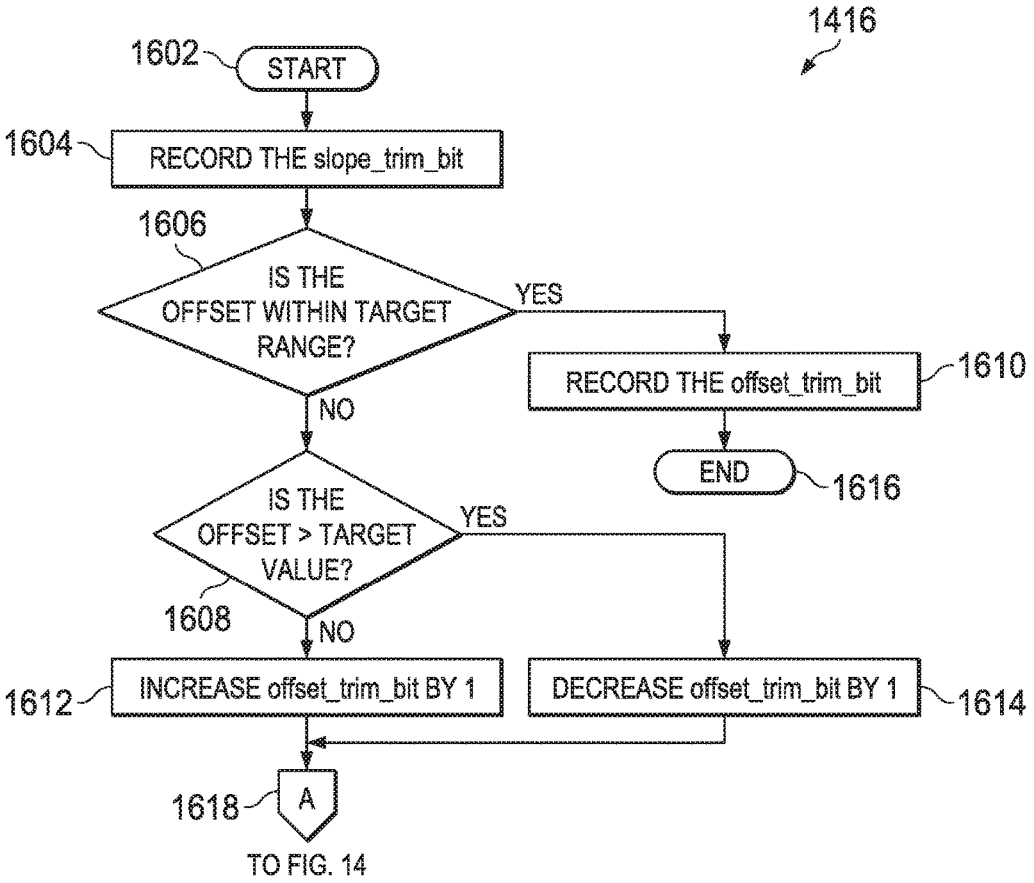
FIG. 16 depicts a flowchart of a process for generating the desired offset of the voltage reference output, according to an illustrative implementation.

FIG. 16 depicts a flowchart of a process for generating the desired offset of the voltage reference output, according to an illustrative implementation. The process of FIG. 16 may be executed by a processor, microcontroller, or other circuitry (e.g., of an external test equipment, or on chip test circuitry that may be located on the same chip, or in a same package, or any combination thereof) configured to execute the process of FIG. 16 (not shown). Process 1416 begins at 1602, which may be after the process 1400 has determined that the temperature slope of the output voltage reference is within the target range, as shown in FIG. 14. The target temperature slope range may be determined by, and the comparison may be made by, a processor, microcontroller, or other circuitry (e.g., of an external test equipment, or on chip test circuitry) configured to execute the process of FIG. 16 (not shown). A processor may then proceed to 1604, where it records the temperature slope trim bit, which may be the temperature slope trim bit that produced the desired temperature slope within the target range. The temperature slope trim bit may be both the first set of programmable temperature control bits 212 and the second set of programmable temperature control bits 214, as shown in FIG. 2. A processor may direct the record to be stored on a memory coupled to the processor, microcontroller, or other circuitry configured to execute the process of FIG. 16. Next, the process 1416 proceeds to 1606, where it determines if the offset is within the target range. The target offset range may be determined by, and the comparison made by any one of the processor, microcontroller, or other circuitry (e.g., of an external test equipment, or on chip test circuitry) configured to execute the process of FIG. 16. If the offset is not in the target range (e.g., the offset is less than or greater than the target offset value), the process may adjust the offset control bits. If the offset is not in the target range, the process 1416 will proceed to 1608, where a processor may determine if the offset is greater than the target value. If the offset is in fact less than the target value, then the process 1416 will proceed to 1612, where a processor may increase the offset trim bit by one. 1612 may correspond to increasing the programmable offset voltage control bits 232, as shown in FIG. 2, by one. Then 1416 will proceed to 1618, and return to process A associated with 1406 as shown with reference to FIG. 14. If, in fact, the offset value is greater than the target offset value, then the process 1416 will instead proceed to 1614, where the processor may decrease the offset trim bit by one. 1614 may correspond to decreasing the programmable offset voltage control bits 232, as shown in FIG. 2, by one. Then it will also proceed to 1618, and return to process A associated with 1406 as shown with reference to FIG. 14.

If the offset voltage value was, in fact, within the target range, then the process 1416 will go to 1610, where the offset trim bit that produced the offset voltage will be recorded, as directed by a processor. The recorded offset trim bit will be stored in a memory coupled to the processor, microcontroller, or other circuitry configured to execute the process of FIG. 16 (not shown). The process will then proceed to the end point 1616, and the process 1416 will be completed. The outcome of process 1416 will be an offset voltage that is within the target range, such that the voltage reference output by the circuit 112, shown in FIG. 2, will have the desired temperature slope and voltage offset.

This description has been presented for the purposes of illustration. It is not intended to be exhaustive or to limit the disclosure to the precise form described, and many modifications and variations are possible in light of the teaching above. The figures are not drawn to scale and are for illustrative purposes. The embodiments were chosen and described in order to best explain the principles of the disclosure and its practical applications. This description will enable others skilled in the art to best utilize and practice the disclosure in various embodiments and with various modifications as are suited to a particular use. The scope of the disclosure is defined by the following claims.

What is claimed is:

1. An apparatus, comprising:

a voltage reference generator configured to produce an output voltage reference with a separately programmable temperature slope and a separately programmable voltage offset, and wherein the voltage reference generator further comprises:

a bandgap reference circuit comprising:

a cascode current mirror formed from a first plurality of field-effect transistors (FETs); and a second plurality of FETs connected to a voltage line;

and wherein the bandgap reference circuit is configured to produce a temperature independent bandgap voltage output and a proportional to absolute temperature (PTAT) current output.

2. The apparatus of claim 1, wherein the bandgap reference circuit is connected to:

a PTAT voltage generator controlled by a first set of programmable temperature control bits;

a complementary to absolute temperature (CTAT) voltage generator controlled by a second set of programmable temperature control bits; and an offset voltage generator programmable with a set of offset voltage control bits.

3. The apparatus of claim 2, wherein the PTAT voltage generator comprises:

a decoder;

an array of input terminals;

an array of switches, wherein each switch of the array of switches is connected to a respective input terminal of the array of input terminals; and an array of resistors connected in series, wherein each resistor of the array of resistors is connected to a respective switch of the array of switches.

4. The apparatus of claim 3, wherein each of the resistors in the array of resistors has substantially the same resistance value.

5. The apparatus of claim 3, wherein each resistor in the array of resistors has a resistance that is a multiple of a resistor within the array of resistors.

6. The apparatus of claim 2, wherein the CTAT voltage generator comprises:

an array of output terminals;

a decoder;

an array of switches, wherein each switch of the array of switches is connected to a respective output terminal in the array of output terminals; and an array of FETs connected in series, wherein each FET in the array of FETs is coupled to a respective switch in the array of switches.

7. The apparatus of claim 6, wherein each of the FETs in the array of FETs has a ratio of a gate width to a gate length that is substantially the same for each FET in the array of FETs.

8. The apparatus of claim 6, wherein each of the FETs in the array of FETs has a first ratio of a first gate width to a first gate length that is a scalar multiple of a second ratio of a second gate width to a second gate length of a proximate FET in the array of FETs, such that closing a switch of the array of switches causes a nonlinear change in a total CTAT voltage drop.

9. The apparatus of claim 6, wherein the array of FETs is an array of NMOS transistors.

10. The apparatus of claim 6, wherein the array of FETs is an array of PMOS transistors.

11. The apparatus of claim 2, wherein the offset voltage generator comprises:

an input terminal;

an array of output terminals connected to the input terminal;

a decoder;

an array of switches, wherein each switch of the array of switches is connected to a respective output terminal in the array of output terminals;

an array or resistors connected in series, wherein each resistor in the array of resistors is connected to a respective switch in the array of switches; and wherein the decoder causes a switch in the array of switches to close, based on the set of offset voltage control bits, to determine an effective total resistance and generate a voltage offset.

12. The apparatus of claim 2, wherein the PTAT voltage generator is connected to a voltage supply and provides an input voltage to the CTAT voltage generator, and an output voltage of the CTAT voltage generator is connected to the offset voltage generator.

13. The apparatus of claim 2, wherein the CTAT voltage generator is connected to a voltage supply and provides an input voltage to the PTAT voltage generator, and an output voltage of the PTAT voltage generator is directed to the offset voltage generator.

14. The apparatus of claim 2, wherein the offset voltage generator is connected to a voltage supply and provides an input voltage to one of the PTAT voltage generator or the CTAT voltage generator.

15. The apparatus of claim 1, further comprising:

a thyristor memory connected to the voltage reference generator;

a phase lock loop circuit connected to the voltage reference generator;

an analog circuit connected to the voltage reference generator; and a digital circuit connected to the voltage reference generator.

16. A method of operating a voltage reference circuit with a thyristor memory, comprising:

setting each of a first set of programmable temperature control bits, a second set of programmable temperature control bits, and a set of programmable offset voltage control bits of the voltage reference circuit, to a set of default codes for each of the respective sets of control bits;

measuring a temperature slope and an offset of a voltage reference output produced by the voltage reference circuit set to the set of default codes;

determining if the temperature slope is within a target temperature slope range;

adjusting the temperature slope if the temperature slope is not within the target temperature slope range; and adjusting the offset of the voltage reference output.

17. The method of claim 16, wherein adjusting the temperature slope further comprises:

determining if the temperature slope is greater than a target temperature slope value, wherein the target temperature slope value is within the target temperature slope range;

decreasing one of the first set of programmable temperature control bits if the temperature slope is greater than the target temperature slope value; and increasing one of the second set of programmable temperature control bits by one if the temperature slope is less than the target temperature slope value.

18. The method of claim 17, wherein adjusting the offset of the voltage reference output further comprises:

determining if the offset is within a target offset range;

determining if the offset is greater than a target offset value, wherein the target offset value is within the target offset range; and adjusting the set of offset voltage control bits by one if the offset is less than or greater than the target offset value and returning to measuring the temperature slope and the offset of the voltage reference output.

* * * * *